United States Patent [19]

Doelp

[11] 3,975,259

[45] Aug. 17, 1976

[54] HYDRODESULFURIZATION OF LIQUID HYDROCARBON UTILIZING A SUSPENDED CATALYST PARTICLE OF LESS THAN 10 MICRONS

[75] Inventor: Louis C. Doelp, Glen Mills, Pa.

[73] Assignee: Air Products and Chemicals, Inc., Allentown, Pa.

[22] Filed: July 10, 1975

[21] Appl. No.: 594,883

[52] U.S. Cl. ..... 208/213; 208/216; 208/217; 208/213;216

[51] Int. Cl.[2] ..... C10G 23/02

[58] Field of Search ..... 208/213, 216

[56] References Cited

UNITED STATES PATENTS

| | | | |
|---|---|---|---|
| 2,892,773 | 6/1959 | Hirsch et al. | 208/213 |
| 2,968,614 | 1/1961 | Brooks et al. | 208/213 |
| 3,558,474 | 1/1971 | Gleim et al. | 208/213 |
| 3,785,967 | 1/1974 | van Klinken | 208/213 |
| 3,849,292 | 11/1974 | Gleim | 208/213 |

*Primary Examiner*—G. J. Crasanakis
*Attorney, Agent, or Firm*—Richard A. Dannells, Jr.; Barry Moyerman

[57] ABSTRACT

A hydrocarbon feedstock, such as a residum from atmospheric or vacuum distillation columns containing large quantities of sulfur is combined with a hydroconversion catalyst having a nominal particle size of less than 10 microns to form a suspension. The resulting suspension and a hydrogen-containing gas are fed upwardly through a contact zone in plug-flow at an elevated temperature and pressure and at a weight hourly space velocity of between 200 and 50,000 kg. of oil per kg. of catalyst per hour. The resulting product containing the catalyst suspended therein is continuously withdrawn from the contact zone. The normally gaseous materials are separated from the liquid product having a substantially reduced sulfur content. The catalyst is carried through the entire process suspended in liquid in a single pass without the necessity of recycling or regeneration and remains in the desulfurized product.

10 Claims, 1 Drawing Figure

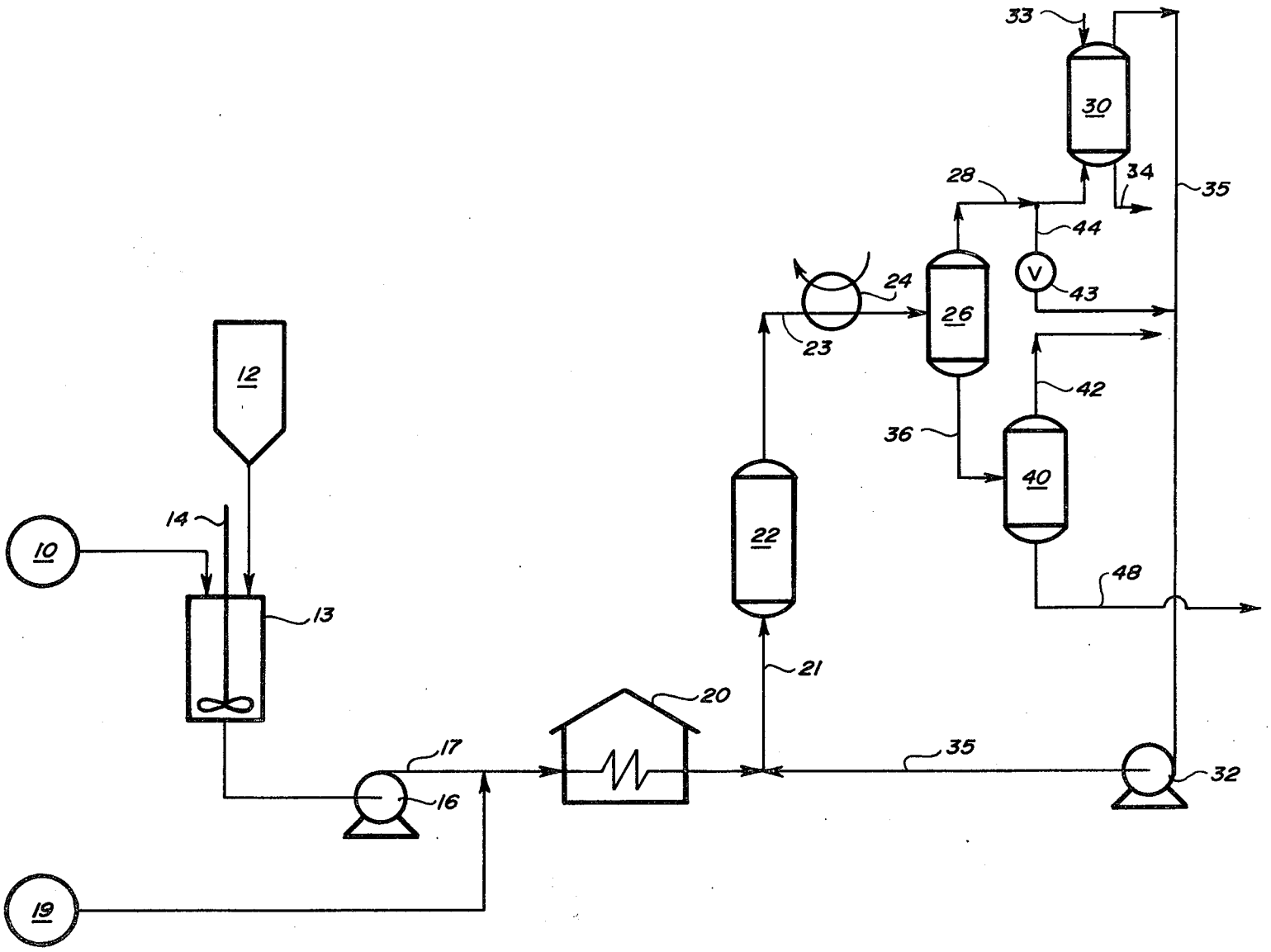
35
34
30
33
44
43
42
40
48
32
28
26
36
24
23
22
21
35
20
17
16
13
12
14
10
19

HYDRODESULFURIZATION OF LIQUID HYDROCARBON UTILIZING A SUSPENDED CATALYST PARTICLE OF LESS THAN 10 MICRONS

BACKGROUND OF THE INVENTION

1. Field of the Invention

This invention relates to the hydrodesulfurization of high boiling hydrocarbon feedstocks. More particularly, it relates to a hydrodesulfurization process employing a finely divided catalyst which remains in suspension throughout the process.

2. Description of the Prior Art

Prior art hydrodesulfurization processes have been traditionally carried out by passing the hydrocarbon feedstock downflow through fixed catalyst beds or upflow through an ebullating catalyst bed. The ebullating bed system is described in Layng et al, U.S. Pat. No. 3,553,105 and comprises introducing the liquid feedstock and hydrogen into the bottom of a contact zone containing either an extruded particulate catalyst ranging in size from 1/32 to 1/16 inch diameter or a microspheroidal catalyst ranging from about 20 to 325 U.S. mesh (841 to 44 microns). The feedstock is passed upwardly through a contact zone at a sufficient space velocity to expand the catalyst bed by at least 10%. The vapor and liquid products do not contain the catalyst and are removed from the top of the contact zone for phase separation and other downstream treatment. The catalyst in such a process must be periodically regenerated and recycled to the contact zone. This procedure involves a loss in production or on-stream time due to shutdown for catalyst regeneration or for replacement of the bed with fresh catalyst. In addition, hydrogen consumption in the prior art processes is high because of undesired hydrocracking and hydrogenation reactions due to the high resistance of hydrogen diffusion into the pores of the relatively large catalyst particles. Increased hydrogen diffusion rates which accompany the much smaller particles of the process of the present invention will reduce the undesired hydrogen consuming reactions.

A recent development in hydrodesulfurization has been the process described in Jacobsen, U.S. Pat. No. 3,841,996. In this process, a hydroconversion catalyst in particulate form having a typical particle size in the range from 0.02 to 0.5 mm (20 to 500 microns) is dispersed in the heavy petroleum feedstock and circulated within a reaction loop at a weight hourly space velocity (WHSV) of from 0.5 to 50 kg. of oil per kg. of catalyst per hour and at an elevated temperature and pressure to effect desulfurization. The feedstock must be circulated within the loop at a sufficient velocity to maintain the relatively large catalyst particles in the dispersion. The effluent from the reaction loop which still contains a portion of the catalyst is separated into a gas phase, a liquid product phase and a solid phase which contains that portion of the catalyst in the effluent in the form of a thick slurry in oil or a paste. This catalyst slurry or paste is recycled to the hydrodesulfurization process. Periodically the catalyst must be subjected to regeneration. Part of the spent catalyst is discarded and replaced with fresh catalyst. In view of the foregoing, this process has some of the same disadvantages as in the case with the traditional processes mentioned above to achieve the necessary process economics.

SUMMARY OF THE INVENTION

In accordance with the process of the present invention, a hydrocarbon feedstock such as a vacuum gas oil or an atmospheric or vacuum residuum containing relatively large quantities of combined sulfur as well as various metallic contaminants is continuously hydrodesulfurized by carrying out the following steps:

a. suspending in the feedstock a hydroconversion catalyst having a nominal particle size of less than 10 microns, i.e. substantially all of the catalyst particles are less than 10 microns,
b. feeding the resulting suspension together with a hydrogen-rich gas through a contact zone at an elevated temperature and pressure and at a WHSV of between 200 and 50,000 kg. of oil per kg. of catalyst per hour,
c. withdrawing the resulting product which contains the catalyst suspended in the liquid portion thereof from the contact zone,
d. separating the normally gaseous materials from the liquid portion, and
e. recovering a liquid product having a substantially reduced sulfur content.

The concentration of the hydroconversion catalyst suspended in the feedstock is critical and ranges from 10 to 10,000 ppm (0.001 to 1.0% by weight) preferably 50 to 5000 ppm on a oncethrough basis and is usually sufficiently low enough to remain in the desulfurized product sold to the customer. Partial removal of solids may be required as the catalyst concentration approaches the 10,000 ppm level. It has been found that for a catalyst concentration in this low range, the feedstock is exposed to adequate catalyst surface area for simultaneous metals sorption and desulfurization to proceed to adequate levels of completion. The catalyst surface area to the weight of said feedstock may be in the range of 0.09 to 33.2 square meters per kilogram of feedstock. It has also been found that the ratio of catalyst surface area to the weight of said feedstock must be in the range of 0.09 to 3.2 square meters per kilogram of feedstock. (45–1580 ft.$^2$/100 lbs. feedstock) to achieve such adequate levels of completion. Thus one is able to operate the present process at steady state conditions without the necessity of making temperature changes to accommodate the deactivation of the catalyst. At the same time, overall catalyst losses are no greater than the catalyst consumption in conventional regenerative processes. This process avoids the necessity of the prior art steps of separating the catalyst from the liquid products, regenerating the catalyst and recycling the catalyst to the contact zone.

The life of the catalyst employed in the present process is designed to coincide with the residence time of the suspended catalyst within the contact zone. The catalyst residence time is slightly greater than the residence time of the liquid in the contact zone, e.g. about 5 to 180 minutes, preferably 15 to 120 minutes. This results in an avoidance of prior art problems of catalyst deactivation and poisoning through coking and accumulation of metals, metal salts and foreign sediment.

It has been found that the concentration of contaminant metals of the large particle catalysts rapidly increases as the radial distance from the center of the catalyst increases. The catalyst becomes completely poisoned with metals when the high concentration gradient is achieved from the center to the shell of the catalyst. For the catalyst particles used in this invention, a lower and more uniform metals poisoning concentration gradient is achieved at the same level of metals poisoning. In other words, the metals are much more evenly distributed throughout the catalyst pores rather than concentrated at or near the outer shell.

The types of catalyst generally recognized as suitable in the hydroconversion of hydrocarbons may be employed in the process of this invention. Examples of such catalysts include cobalt-molybdate and/or nickel molybdate deposited on alumina. Other combinations of the oxides or sulfides of nickel, cobalt, molybdenum, and tungsten and mixtures thereof deposited or otherwise supported on alumina, silica, magnesia, aluminosilicate zeolites and mixtures thereof can be used. The catalysts must be capable of being ground or additionally formed into very finely divided particles of the critical size. Preferably the finely divided catalyst should have substantially all of the particles in the range of 0.1 to 9 microns and still more preferably in the range of 0.5 to 1 micron. Particles of the most preferred size range are capable of being colloidally suspended in the feedstock and do not settle out during the entire desulfurization process and hence do not cause unacceptable coking during the reaction.

BRIEF DESCRIPTION OF THE DRAWING

The drawing is a schematic flow diagram of the hydrodesulfurization process of the present invention.

DESCRIPTION OF THE PREFERRED EMBODIMENT

In the drawing, a hydrocarbon feedstock such as an atmospheric residuum, a vacuum column bottoms or a vacuum gas oil having an initial boiling point of at least 250°C and containing appreciable quantities of sulfur and metallic components from source 10 is intimately mixed with a small amount of a finely divided sulfur-resistant hydroconversion catalyst from source 12, to form a colloidal suspension within mixing zone 13 with agitator or dispersing means 14. Mixing zone 13 is preferably equipped with a steam jacket or other means for indirect heating. The resulting suspension is pumped from zone 13 via pump 16 through line 17, combined with hydrogen-rich gas from source 19 and the resulting three phase system is heated to the temperature necessary for desulfurization in preheater 20. The system is then passed via line 21 through reactor 22. The reactor may contain mass transfer media such as sieve trays, a sparger and the like. The effluent including the desulfurized liquid product containing the catalyst colloidally suspended therein is removed from the top of the reactor 22 via line 23 and is passed through condenser 24 and into a high pressure separation zone 26. The off-gas containing light hydrocarbons, unreacted hydrogen and a portion of the hydrogen sulfide is withdrawn from the process through line 28. The off-gas is passed into hydrogen sulfide scrubber 30, where a scrubbing liquid, e.g. water or ethanol amine, enters through line 33. The spent liquor containing dissolved hydrogen sulfide is drawn off through line 34 for further recovery. The scrubbed gas is then recycled through lines 35 and 21 by means of recycle compressor 32 to reactor 22.

The desulfurized liquid product is removed from the bottom of high pressure separator 26 via line 36 to low pressure separation zone 40. The off gas from the low pressure separation zone 40 is withdrawn through line 42 and may either be vented as such or subjected to further treatment (not shown). The desulfurized product containing entrained catalyst is passed via line 48 to storage (not shown). If one desires, the colloidally suspended catalyst with its sorbed metals can be removed from this product by suitable techniques such as centrifuging (not shown). However, because of the small amounts entrained in the liquid product such a removal step is usually not required.

A portion of the unscrubbed gas may be passed through valve 43 and line 44 and combined with the hydrogen sulfide-free scrubbed gas from scrubber 30. The mixture of the two gases may then be recycled via line 35, recycle compressor 32 and line 21 to reactor 22. The purpose of this alternative is to enable recycle of some hydrogen sulfide, which is believed to benefit the catalytic reaction in reactor 22.

The broad range and preferred reactor 22 operating conditions are set forth in Table I below:

TABLE I

Reactor Operating Conditions

| | | Broad Range | Preferred |
|---|---|---|---|
| Temperature, | °C | 90–540 | 260–480 |
| | (°F) | (200–1,000) | (500–900) |
| Pressure, kilopascals | | 1,380–20,700 | 5,500–13,800 |
| (psig) | | (200–3,000) | (800–2,000) |
| Space Velocity, | LHSV | 0.1–10 | 0.4–4.0 |
| | WHSV | 200–50,000 | 500–2,000 |
| Hydrogen to Oil Ratio mol./mol. | | 0.5–20 | 2–10 |

The following examples illustrate operating the process of the present invention within the foregoing preferred range of operating conditions.

EXAMPLES 1–3 AND CONTROLS 1–3

A vacuum gas oil, which is one of the typical feedstocks of the process specified in Table II below, was desulfurized in a pilot plant reactor unit in accordance with a modified version of the schematic process flow diagram described above.

TABLE II

Feedstocks for Hydrodesulfurization

| Analysis | Vacuum Gas Oil (VGO) | | Atmospheric Residuum (AR) | |
|---|---|---|---|---|
| Gravity, °API | 20.5 | | 11.6 | |
| Sulfur, wt.% | 3.15 | | 4.35 | |
| Nickel, ppm | 2.0 | | 110 | |
| Vanadium, ppm | 0.1 | | 500 | |
| Nitrogen, wt.% | 0.1 | | 0.28 | |
| Con. Carbon, wt.% | 0.43 | | 7.0 | |
| Rams Bottom, wt.% | 0.40 | | 5.8 | |
| Asphaltenes, wt.% | 0.01 | | 13.25 | |
| Viscosity, SUS at 99°C (210°F) | 47.7 | | 349.0 | |
| Distillation | °F | °C | °F | °C |
| Int. BP | 592 | 311 | 522 | 272 |
| 15% | 710 | 376 | 755 | 402 |
| 50% | 830 | 444 | 1005 | 540 |
| 70% | 890 | 477 | Cracked | — |
| 90% | 972 | 512 | Cracked | — |
| 95% | 1002 | 539 | Cracked | — |

A hydrodesulfurization catalyst was micropulverized to a nominal particle size of 7.5 microns. The resulting finely divided catalyst was suspended in the feedstock in steam-jacketed mixer 13 by means of agitator 14 and a nitrogen sparger (not shown). The catalyst consisted of 3% by weight CoO and 15% by weight $MoO_3$ deposited on gamma alumina an is referred to herein as Catalyst A. The catalyst was prepared by techniques well known in the art. The resulting suspension from mixer 13 was pumped through heated line 17 at approximately 38°–49°C (100°–120°F). After the hydrogen was introduced into the suspension at the $H_2$/Oil Ratio specified in Table III below, the three phase system was passed through preheater 20 where it was heated to the temperature indicated in Table III. The heated system was then passed upflow through reactor 22 in plug-flow at the space velocity and pressure set forth in Table III. The three phase system had a residence time in the reactor of approximately 11.5 minutes. The catalyst surface area exposed to the feedstock during this time was 2.55 $m^2$/kg. feed (12.48 $ft.^2$/lb.).

The reaction product from the top of reactor 22 was cooled to about 93°C (200°F) in steam cooled condenser 24 and passed into high pressure separator 26. The mixture was separated into a high pressure gas which was withdrawn through line 28. The liquid product was withdrawn via line 36 and passed through a pressure let-down valve (not shown) into low pressure receiver 40, where a low pressure gas and the liquid product were separated. The low pressure gas was withdrawn through line 42 and combined with the high pressure gas (after its pressure was relieved). The combined gas was vented. The liquid product from the low pressure receiver 40 was withdrawn through line 48. This product was analyzed for °API and sulfur content to determine the weight % desulfurization as reported in Table III. In addition, the total solids content in this final product was measured by Soxhlet extraction to verify whether all of the catalyst in the feed was entrained in the product. Scrubber 30, recycle compressor 32, and the associated lines as shown in the drawing were not used in this pilot plant example.

TABLE III

| EXAMPLE | 1 | 2 | 3 | Control 1 | Control 2 | Control 3 |
|---|---|---|---|---|---|---|
| Operating Conditions | | | | | | |
| Catalyst | | | | None | None | None |
| Type[1] | A | A | A | | | |
| Nominal Size,[2] $\mu$ | 7.5 | 7.5 | 7.5 | — | — | — |
| Concentration, ppm | 8000 | 8000 | 8000 | — | — | — |
| Pressure, kilopascals | 5516 | 5516 | 8274 | 5516 | 5516 | 8274 |
| Temperature, °C | 400 | 427 | 402 | 400 | 427 | 402 |
| Space Velocity | | | | | | |
| LHSV | 3.3[3] | 3.3[3] | 3.3[3] | 3.3 | 3.3 | 3.3 |
| WHSV | 650 | 650 | 650 | — | — | — |
| $H_2$/Oil Ratio, mol./mol. | 3.0 | 3.0 | 3.0 | 3.0 | 3.0 | 3.0 |
| Feedstock | VGO | VGO | VGO | VGO | VGO | VGO |
| Results | | | | | | |
| Desulfurization, wt.% | 20.0 | 44.7 | 40.3 | 3.1 | 3.1 | 5.0 |

NOTES:
[1]Catalyst A is $CoO/MoO_3$ on alumina.
[2]Calculated based on ratio of total volume to area of catalyst.
[3]Reactor was packed with 6.35 mm (¼") alumina balls and LHSV is based on a void fraction of 0.297 for the packing.

A comparison is made in Table III between the results of Examples 1–3 and those of Controls 1–3 in which the same vacuum gas oil feedstock was subjected to the same conditions but without the use of a catalyst.

This comparison illustrates that in fact the process of this invention achieves a high degree of catalytic hydrodesulfurization as opposed to the very small amount of thermal hydrodesulfurization during the control runs. Some coking and plugging of the reactor was evident at the end of approximately one hour of continuous desulfurization to obtain the data for Examples 1–3. It is believed that the coking and plugging were at least in part due to the use of a packed reactor.

EXAMPLES 4–12

The same feedstock was desulfurized using the same procedure as that set forth in Examples 1–3 except that the reactor was not packed and catalyst B containing 3% by weight NiO and 15% by weight $MoO_3$ deposited on gamma alumina was employed in place of catalyst A. Catalyst B was prepared in the same manner as catalyst A. The operating conditions and results are summarized in Table IV below:

TABLE IV

| EXAMPLE | 4 | 5 | 6 | 7 | 8 | 9 | 10 | 11 | 12 |
|---|---|---|---|---|---|---|---|---|---|
| Operating Conditions | | | | | | | | | |
| Catalyst | | | | | | | | | |
| Type[1] | B | B | B | B | B | B | B | B | B |
| Nominal Size,[2] $\mu$ | 8.8 | 8.8 | 8.8 | 8.8 | 8.8 | 8.8 | 8.8 | 8.8 | 8.8 |
| Concentration, ppm | 8000 | 8000 | 8000 | 8000 | 8000 | 8000 | 2000 | 2000 | 2000 |
| Pressure, kilopascals | 2958 | 5516 | 8274 | 8274 | 8274 | 8274 | 5516 | 5516 | 5516 |
| Temperature °C | 454 | 455 | 455 | 414 | 429 | 441 | 463 | 465 | 468 |
| Space Velosity | | | | | | | | | |
| LHSV | 3.3 | 3.3 | 3.3 | 3.3 | 3.3 | 3.3 | 1.5 | 1.5 | 1.5 |
| WHSV | 650 | 650 | 650 | 650 | 650 | 650 | 1200 | 1200 | 1200 |
| Residence Time, min. | 11.5 | 11.5 | 11.5 | 11.5 | 11.5 | 11.5 | 25 | 25 | 25 |
| $H_2$/Oil Ratio/mol./mol. | 3.0 | 3.0 | 3.0 | 3.0 | 3.0 | 3.0 | 9.8 | 7.0 | 5.2 |
| Surface Area on Feed,[3] $m^2$/Kg. | 2.17 | 2.17 | 2.17 | 2.17 | 2.17 | 2.17 | 0.54 | 0.54 | 0.54 |
| Feedstock | VGO | VGO | VGO | VGO | VGO | VGO | VGO | VGO | VGO |
| Results | | | | | | | | | |
| Desulfurization, wt.% | 36.6 | 63.1 | 78.4 | 40.3 | 75.0 | 70.0 | 62.5 | 52.5 | 37.5 |

TABLE IV-continued

| EXAMPLE | 4 | 5 | 6 | 7 | 8 | 9 | 10 | 11 | 12 |
|---|---|---|---|---|---|---|---|---|---|
| Product Recovery, Vol.% | 99.8 | 96.8 | 96.8 | 100.3 | 101.4 | 101.1 | 89.8 | 92.9 | 89.0 |

NOTE:
(1)Catalyst B is $NiO/MoO_3$ on alumina.
(2)Calculated based on ratio of total volume to area of catalyst.
(3)The catalyst surface area that is exposed to the feedstock.

Examples 4–6 illustrate that increasing the pressure increased the percent desulfurization. Examples 6–9 illustrate that increasing the temperature increased the percent desulfurization but decreased the volume recovery of product (selectivity). This occurred because simultaneous to desulfurization, hydrocracking also occurred. At the lower operating temperatures, hydrocracking was not severe enough to produce light-end gases, but was severe enough to cause a density reduction and hence a volume recovery increase. Under the high pressure, high temperature conditions of Example 6, hydrocracking produced light-end gases which were removed with the other off-gases which lowered the selectivity. However, the Example 6 operating conditions represent the best mode from the standpoint of weight percent desulfurization.

Examples 10–12 illustrate that increasing the $H_2$/oil ratio increased the percent desulfurization with all other conditions remaining substantially constant. One notes on comparing the volume recovery of Example 10 with Example 5, that the combination of a decreased space velocity, an increased $H_2$/oil ratio and a decreased catalyst concentration resulted in a lower product liquid yield at essentially the same desulfurization level.

Less plugging and coking problems were experienced during Examples 4–12 than were experienced during Examples 1–3. This result is believed to be due to the fact that the reactor was not packed as it was in Examples 1–3.

EXAMPLES 13–17

In these examples each of the catalysts A and B were first dispersed in a small amount of VGO and subjected to a high impact device which utilized sand as the grinding and dispersing medium. The resulting slurry was screened to separate the sand from the catalyst slurry. The nominal particle sizes of the catalyst particles were reduced from 7.5 to 5 microns and 8.8 to 3 microns, based on the ratio of total volume to area of catalyst, for Catalysts A and B respectively. Each of the sand milled catalysts were then suspended in the feedstock and desulfurized in the same manner described in Examples 4–12. The operating conditions and results for these examples are summarized in Table V:

TABLE V

| EXAMPLE | 13 | 14 | 15 | 16 | 17 | 18 | 19 | 20 |
|---|---|---|---|---|---|---|---|---|
| Operating Conditions | | | | | | | | |
| Catalyst | | | | | | | | |
| Type | B(4) | B(1),(4) | B(4) | B(4) | B(4) | A(5) | A(5) | A(5) |
| Nominal Size,(2)$\mu$ | 3 | 3 | 3 | 3 | 3 | 5 | 5 | 5 |
| Concentration, ppm | 1155 | 1155 | 116 | 116 | 116 | 976 | 976 | 976 |
| Pressure, kilopascals | 5516 | 5516 | 5516 | 5516 | 5516 | 5516 | 5516 | 5516 |
| Temperature °C | 453 | 453 | 453 | 400 | 426 | 397 | 425 | 454 |
| Space Velocity | | | | | | | | |
| LHSV | 2.0 | 2.0 | 2.0 | 2.0 | 2.0 | 2.0 | 2.0 | 2.0 |
| WHSV | 2620 | 2620 | 25,890 | 25,890 | 25,890 | 3100 | 3100 | 3100 |
| Residence Time, min. | 20 | 20 | 20 | 20 | 20 | 20 | 20 | 20 |
| $H_2$/Oil Ratio, mol./mol. | 3.0 | 3.0 | 3.0 | 3.0 | 3.0 | 3.0 | 3.0 | 3.0 |
| Surface Area on Feed,(3)$m^2$/Kg. | 0.92 | 0.92 | 0.09 | 0.09 | 0.09 | 0.47 | 0.47 | 0.47 |
| Feedstock | VGO | VGO | VGO | VGO | VGO | VGO | VGO | VGO |
| Results | | | | | | | | |
| Desulfurization, wt.% | 33.4 | 44.4 | 16.9 | 14.1 | 22.2 | 5.9 | 17.2 | 19.1 |
| Product Recovery, vol.% | 97.2 | 98.7 | 95.3 | 100.1 | 100.6 | 100.2 | 100.4 | 99.7 |

NOTES:
(1)Catalyst was presulfided before use in process of this invention.
(2)Calculated based on ratio of total volume to area of catalyst.
(3)The catalyst surface area that is exposed to the feedstock.
(4)Catalyst B is $NiO/MoO_3$ on alumina.
(5)Catalyst A is $CoO/MoO_3$ on alumina.

Examples 13 and 14 illustrate the significant improvement presulfiding the sand-milled catalyst had on desulfurization. The catalyst was sulfided in an autoclave at 1720 kilopascals (250 psi) of $H_2S$ at 350°F for 2 hours.

Examples 14 and 15 show that a 10-fold increase in WHSV and a 10-fold decrease in surface area caused an approximately 3-fold decrease in percent desulfurization.

The overall observation was that the plugging and coking problems of Examples 1–12 were greatly reduced during Examples 13–20. This result is believed to be due to the fact that substantially all of the particles making up the catalysts for each of these examples were no greater than 5 microns.

EXAMPLES 21–25

Using the same procedure set forth under Examples 4–12, an atmospheric residuum specified in Table II was desulfurized in place of the VGO of Examples 1–20. Table VI summarizes the operating conditions and results:

TABLE VI

| Example | 21 | 22 | 23 | 24 | 25 |
|---|---|---|---|---|---|
| Operating Conditions | | | | | |
| Catalyst | | | | | |
| Type[1] | B | B | B | B | B |
| Nominal Size,[2] $\mu$ | 8.8 | 8.8 | 8.8 | 8.8 | 8.8 |
| Concentration, ppm | 2000 | 2000 | 5874 | 5874 | 5874 |
| Pressure, kilopascals | 8274 | 8274 | 8274 | 8274 | 8274 |
| Temperature °C | 402 | 425 | 399 | 398 | 397 |
| Space Velocity | | | | | |
| LHSV | 1.5 | 1.5 | 0.5 | 1.0 | 2.0 |
| WHSV | 1200 | 1200 | 128 | 256 | 512 |
| Residence Time, min. | 25 | 25 | 80 | 40 | 20 |
| $H_2$/Oil Ratio, mol./mol. | 7.0 | 7.0 | 3.0 | 3.0 | 3.0 |
| Surface Area on Feed,[3] $m^2$/Kg. | 0.54 | 0.54 | 1.6 | 1.6 | 1.6 |
| Feedstock | AR | AR | AR | AR | AR |
| Results | | | | | |
| Desulfurization, wt.% | 13.5 | 17.9 | 34.0 | 26.5 | 15.6 |
| Product Recovery, vol.% | 107.5 | 93.8 | 101.8 | 103.5 | 101.7 |

NOTES:
[1]Catalyst B is $NiO/MoO_3$ on alumina.
[2]Calculated based on ratio of total volume to area of catalyst.
[3]The catalyst surface area that is exposed to the feedstock.

Some coking was experienced during Examples 21–25.

EXAMPLES 26–33 AND CONTROLS 4–5

These examples and controls show the effect the particle size of the catalyst has on desulfurization. The examples were conducted using Catalyst B, the high metals catalyst described above, and Catalyst C, a low metals catalyst comprising 5% by weight $MoO_3$ and 1% by weight NiO deposited on gamma alumina.

Table VII sets forth the particle size distribution for the catalyst used in Examples 26–28 and 32–33 and the calculation of the nominal particle size for this catalyst based on such a distribution. Similarly, Table VIII sets forth the particle size distribution and nominal particle size calculation for the catalyst used in Controls 4–5.

TABLE VII

| Arithmetic Mean Particle Size, $\mu$ | No. of Particles |
|---|---|
| 0.35 | 36 |
| 0.75 | 17 |
| 1.25 | 380 |
| 1.75 | 152 |
| 2.25 | 110 |
| 2.75 | 86 |
| 3.25 | 71 |
| 3.75 | 36 |
| 4.25 | 14 |
| 4.75 | 13 |
| 5.25 | 14 |
| 5.75 | 10 |
| 6.25 | 5 |
| 6.75 | 5 |

Nominal particle size = $\frac{\Sigma N_i d_i^3}{\Sigma N_i d_i^2} = 3.7\mu$ where $N_i$ = number of particles of arithmetic mean size $d_i$.

TABLE VIII

| Arithmetic Mean Particle Size, $\mu$ | No. of Particles |
|---|---|
| 0.8 | 82 |
| 1.5 | 447 |
| 2.5 | 517 |
| 3.5 | 230 |
| 4.5 | 174 |
| 5.5 | 161 |
| 6.5 | 111 |
| 7.5 | 57 |
| 8.5 | 50 |
| 9.5 | 31 |
| 10.5 | 16 |
| 11.5 | 26 |
| 12.5 | 8 |
| 13.5 | 5 |
| 14.5 | 4 |
| 15.5 | 2 |
| 16.5 | 1 |
| 17.5 | 1 |
| 19.5 | 1 |
| 21.5 | 1 |
| 23.5 | 1 |
| 24.5 | 1 |
| 25.5 | 1 |
| 30.5 | 1 |
| 31.5 | 1 |
| 34.5 | 1 |
| 35.5 | 1 |

Nominal particle size = $\frac{\Sigma N_i d_i^3}{\Sigma N_i d_i^2} = 10.5\mu$ where $N_i$ = number of particles of arithmetic mean size $d_i$.

Table IX sets forth the process conditions and results of Examples 26–33 and Controls 4–5, which were carried out using the same procedures used in Examples 4–12.

TABLE IX

| EXAMPLE | 26 | 27 | 28 | 29 | 30 | 31 |
|---|---|---|---|---|---|---|
| Operating Conditions | | | | | | |
| Catalyst | | | | | | |
| Type | B[1],[3] | B[1],[3] | B[1],[3] | C[1],[4] | C[1],[4] | B[1],[4] |
| Nominal Size, $\mu$[5] | 3.7 | 3.7 | 3.7 | 3.7 | 3.7 | 7.4 |
| Concentration, ppm | 1000 | 2000 | 4000 | 2000 | 5000 | 1000 |
| External Surface Area/Unit of Feedstock, $m.^2$/Kg. | 0.65 | 1.3 | 2.6 | 1.3 | 3.25 | 0.32 |
| Pressure, kilopascals | 5516 | 5516 | 5516 | 5516 | 5516 | 5516 |
| Temperature, °C | 440 | 440 | 440 | 440 | 440 | 440 |
| Space Velocity | | | | | | |
| LHSV | 1.5 | 1.5 | 1.5 | 1.5 | 1.5 | 1.5 |
| WHSV | 2398 | 1199 | 600 | 1199 | 480 | 2398 |

TABLE IX-continued

| | | | | | | |
|---|---|---|---|---|---|---|
| $H_2$/Oil Ratio, mol./mol. | 6.0 | 6.0 | 6.0 | 6.0 | 6.0 | 6.0 |
| Feedstock | VGO | VGO | VGO | VGO | VGO | VGO |
| Results | | | | | | |
| Desulfurization, wt.%[2] | 33.0 | 40.8 | 61.2 | 31.3 | 34.5 | 23.0 |

| EXAMPLE | 32 | 33 | Control 4 | Control 5 |
|---|---|---|---|---|
| Operating Conditions | | | | |
| Catalyst | | | | |
| Type | B[1],[3] | B[1],[3] | C[1],[4] | C[1],[4] |
| Nominal Size, $\mu$ | 7.4 | 7.4 | 10.5 | 10.5 |
| Concentration, ppm | 2000 | 4000 | 2000 | 5000 |
| External Surface Area/Unit of Feedstock, m.²/Kg. | 0.65 | 1.3 | 0.46 | 1.15 |
| Pressure, kilopascals | 5516 | 5516 | 5516 | 5516 |
| Temperature | 440 | 440 | 440 | 440 |
| Space Velocity | | | | |
| LHSV | 1.5 | 1.5 | 1.5 | 1.5 |
| WHSV | 1199 | 600 | 1199 | 480 |
| $H_2$/Oil Ratio, mol./mol. | 6.0 | 6.0 | 6.0 | 6.0 |
| Feedstock | VGO | VGO | VGO | VGO |
| Results | | | | |
| Desulfurization, wt.%[2] | 28.3 | 39.2 | 20.6 | 30.6 |

NOTES:
[1]Catalyst was presulfided as described in Example 14.
[2]Based on average of two separate runs.
[3]Catalyst B is $NiO/MoO_3$ on alumina.
[4]Catalyst C is $MoO_3/NiO$ on alumina.
[5]Calculated based on ratio of total volume to area of catalyst.

Examples 26–28 compared with Examples 31–33, respectively, show that a dramatic decrease in percent desulfurization occurred for the high metals catalyst as the particle size of the catalyst was doubled. A decrease in percent desulfurization also occurred for the low metals catalyst as the catalyst size was subjected to an approximately 3-fold increase. Compare Examples 29 and 30 with Controls 4–5, respectively.

The on-stream times of these experiments were too short to produce noticeable differences in the settling, plugging and coking levels between the examples and the controls. However, it has been calculated that the linear velocity of the liquid feedstock in the reactor during these experiments was about 3 times the settling velocity for the largest particles in the catalyst used in Examples 26–30 and was about 1/10 the settling velocity for the largest particles in the control catalyst. Therefore, it is believed that if the control runs were of longer duration, they would have ended prematurely due to unacceptably high levels of settling, plugging and coking.

Specific modes of operation of the process of the present invention have been described above including passing the feedstock upflow through a plugflow reactor. It is contemplated that this process can also be designed with a number of variations including passing the feed downflow and employing a back-flow reactor without departing from the spirit of this invention. All such variations that fall within the scope of the appended claims are intended to be embraced thereby.

I claim:

1. A hydrodesulfurization process which comprises the following steps:

a. suspending a hydroconversion catalyst having a nominal particle size of less than 10 microns in a liquid hydrocarbon feedstock, said catalyst being selected from the group consisting of the metal, metal oxide and metal sulfide of nickel, cobalt, molybdenum, tungsten and mixtures thereof, supported on alumina, silica, magnesia, aluminosilicate zeolite and mixtures thereof, b. feeding the resulting suspension together with a hydrogen-rich gas through a contact zone at an elevated temperature and pressure and at a weight hourly space velocity of between 200 and 50,000 kg. of oil per kg. of catalyst per hour, c. withdrawing the effluent containing said catalyst therein from said contact zone, d. separating the normally gaseous materials from the liquid portion of said effluent, and e. recovering a liquid product from said liquid portion of step (d) having substantially reduced sulfur content.

2. The process of claim 1 wherein the concentration of said catalyst suspended in the feedstock is in the range of about 0.001 to 1.0% by weight.

3. The process of claim 1 wherein said temperature is in the range of about 90° to 540°C and said pressure is in the range of about 1,380 to 20,700 kilopascals.

4. The process of claim 3 wherein the ratio of hydrogen to feedstock in step (b) is in the range of about 0.5 to 20 mol./mol.

5. The process of claim 1 wherein said nominal particle size is in the range of 0.1 to 9 microns.

6. The process of claim 1 wherein said nominal particle size is in the range of 0.5 to 1 micron.

7. The process of claim 2 wherein the ratio of surface area of said catalyst to the weight of said feedstock is in the range of about 0.09 to 33.2 square meters per kilogram of feedstock.

8. A hydrodesulfurization process which comprises the following steps:

a. suspending 50 to 5,000 ppm of a hydroconversion catalyst having a nominal particle size in the range of 0.1 to 9 microns in a liquid hydrocarbon feedstock, said catalyst being selected from the group consisting of the metal, metal oxide and metal sulfide of nickel, cobalt, molybdenum, tungsten and mixtures thereof, supported on alumina, silica, magnesia, aluminosilicate zeolite and mixtures thereof, b. feeding the resulting colloidal suspension together with a sufficient quantity of a hydrogen-rich gas such that the ratio of hydrogen to feedstock is in the range of about 2 to 10 mol./mol. upwardly through a plug-flow reactor at a temperature in the range of about 260° to 480°C, a pressure in the range of about 5500 to 13,800 kilopascals, and a weight hourly space velocity in the range of about 500 to 2000 kg. of oil per kg. of catalyst per hour, c. withdrawing the effluent containing catalyst suspended therein from said reactor, d. separating the normally gaseous materials from the liquid portion of said effluent, and e. recovering a liquid product from said liquid portion of step (d) having substantially reduced sulfur content.

9. The process of claim 8 wherein said nominal particle size is in the range of 0.5 to 1 micron.

10. The process of claim 8 wherein the ratio of surface area of said catalyst to the weight of said feedstock is in the range of about 0.09 to 3.2 square meters per kilogram of feedstock.

* * * * *